United States Patent [19]

Watanabe et al.

[11] Patent Number: 4,950,183

[45] Date of Patent: Aug. 21, 1990

[54] ELECTRICAL CONNECTOR

[75] Inventors: Hiroshi Watanabe; Katsuaki Terada, both of Shizuoka, Japan

[73] Assignee: Yazaki Corporation, Tokyo, Japan

[21] Appl. No.: 411,390

[22] Filed: Sep. 22, 1989

[30] Foreign Application Priority Data

Oct. 7, 1988 [JP] Japan ..... 63-131024

[51] Int. Cl.[5] ..... H01R 13/00

[52] U.S. Cl. ..... 439/843; 439/852

[58] Field of Search ..... 439/843, 844, 845, 847, 439/849, 850, 852, 853

[56] References Cited

U.S. PATENT DOCUMENTS

| | | | |
|---|---|---|---|
| 3,076,171 | 1/1963 | Hopkins | 439/849 |
| 3,836,947 | 9/1974 | Yeager | 439/852 |
| 4,564,259 | 1/1986 | Vandame | 439/852 |

FOREIGN PATENT DOCUMENTS

| | | | |
|---|---|---|---|
| 1330870 | 5/1963 | France | 439/850 |

*Primary Examiner*—Joseph H. McGlynn

*Attorney, Agent, or Firm*—Venable, Baetjer and Howard

[57] ABSTRACT

An electrical connector of the present invention comprises a substantially rectangular, sleeve-shaped electrically contacting portion in which a male terminal is to be inserted, and an electric wire connecting portion of a substantially U-shape in section which is formed integrally with the electrically contacting portion for fixedly securing an electric wire thereto. The arrangement is made such that a resilient contact piece formed by extending one wall of said electrically contacting portion is located in the electrically contacting portion, and a projection is formed by projecting part of the other wall opposite to the resilient contact piece towards the latter to thereby enable a male terminal to be gripped resiliently and held between the projection and said resilient contact piece. The electrical connector further comprises a protective wall formed by extending a side wall of said electrically contacting portion so that it may contact with and cover the outer surface of said other wall of said electrically contacting portion, thereby preventing said projection from bulging towards said resilient contact piece.

1 Claim, 3 Drawing Sheets

ELECTRICAL CONNECTOR

BACKGROUND OF THE INVENTION

1. Field of the Invention

This invention relates to a female electrical connector having a substantially sleeve-shaped electrically contacting portion in which a male terminal is to be inserted.

2. Description of the Prior Art

A female electrical connector which is comprised of a sleeve-shaped electrically contacting portion and an electric wire connecting portion of a substantially U-shape in section is so far known.

Disposed in the above-mentioned electrically contacting portion is a resilient contact piece formed by folding back a strip defined by extending one end of the rear plate portion thereof and bending the strip in a circular-arc shape so as to give it a resiliency. Further, this electrically contacting portion has a projection formed on the wall thereof opposite to the resilient contact piece and which projects towards the latter. The arrangement is made such that a male terminal can be gripped between the resilient contact piece and the projection to make electrical connection with the male terminal. The contact pressure in the electrically contacting portion, and hence, the force required to insert the male terminal is determined by the spacing between the resilient contact piece and the projection.

Further, the arrangement is made such that an electric wire, the core of which is exposed by peeling off the insulating coating at its portion to be electrically connected, is fixedly secured to the above-mentioned electric wire connecting portion by a suitable means such as clamping or the like.

The above-mentioned electrical connector has been disadvantageous in that, when external forces are exerted on its walls to cause deformation of the projections towards the resilient contact piece, the above-mentioned spacing is narrowed thus requiring application of increased contact pressure in the electrically contacting portion, and hence, increased male terminal inserting force, and if the insertion of the male terminal is made repeatedly in this condition, then the curved portion of the resilient contact piece is deformed generally in a flat shape so that the resilient contact piece 112 loses its resiliency, and as a result, the contact pressure in the electrically contacting portion 100 is reduced, thus causing a poor electrical contact.

The present invention has for its object to solve the above-mentioned problem in the prior art and provide an electrical connector which is free from the risk of electrically contacting portion causing a poor electrical contact due to the deformation thereof.

SUMMARY OF THE INVENTION

To achieve the above-mentioned objects, an electrical connector according to the present invention comprises a substantially rectangular, sleeve-shaped electrically contacting portion in which a male terminal is to be inserted, and an electric wire connecting portion of a substantially U-shape in section which is formed integrally with the electrically contacting portion for fixedly securing an electric wire thereto, and is arranged such that a resilient contact piece formed by extending one wall of the electrically contacting portion is located in the electrically contacting portion, and a projection is formed by projecting part of the other wall of the electrically contacting portion opposite to the resilient contact piece towards the latter to thereby enable a male terminal to be gripped resiliently and held between the projection and the resilient contact piece, and further a protective wall is formed by extending a side wall of the electrically contacting portion so that it may contact with and cover the outer surface of the other wall of the electrically contacting portion thereby preventing the projection from bulging towards the resilient contact piece.

Thus, even when external forces are exerted on the electrically connecting portion, the projection is protected by the protective wall so that there is no risk of the projection deflecting towards the resilient contact piece; in other wards, there is no possibility of the spacing between the resilient contact piece and the projection being narrowed excessively.

DETAILED DESCRIPTION OF THE INVENTION

The present invention will now be described below by way of example only with reference to the accompanying drawings.

Figure 1:
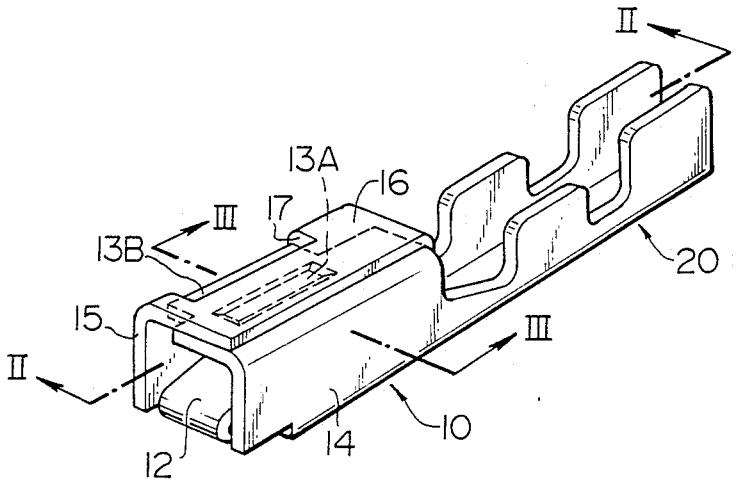
FIG. 1 is a perspective view of an embodiment of an electrical connector according to the present invention.
Figure 2:
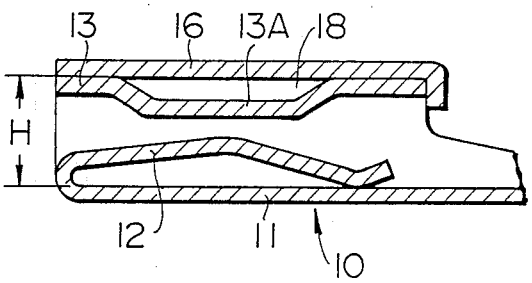
FIG. 2 is a sectional view of the electrical connector taken along line II—II in FIG. 1.
Figure 3:
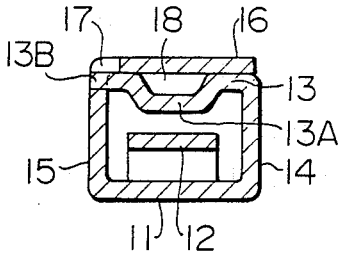
FIG. 3 is a sectional view of the same taken along line III—III in FIG. 1.

FIGS. 1 to 3 illustrate one embodiment of the electrical connector according to the present invention. FIG. 1 is a perspective view of the electrical connector. FIG. 2 is a longitudinal sectional view of the same. FIG. 3 is a transverse sectional view of the same. In the drawings, reference numeral 10 denotes a rectangular, sleeve-shaped electrically contacting portion, and 20 an electric wire connecting portion of a U-shape in section.

Disposed in the electrically contacting portion 10 is a resilient contact piece 12 formed by folding back a strip defined by extending one end of the rear plate portion thereof and then bending the strip in a circular-arc shape so as to give it a resiliency. Further, the electrically contacting portion 10 has a projection 13A formed on the wall portion 13 thereof opposite to the resilient contact piece 12; that is, the rear plate portion 11 and which projects towards the latter. The arrangement is made such that a male terminal can be gripped between the resilient contact piece 12 and the projection 13A.

The wall portion 13 is formed by folding inwardly the end of one side plate 14 standing upright at a side edge of the rear plate portion 11 substantially at right angles to the side plate 14. The outer surface of the wall portion 13 is adapted to be kept in contact with and covered by a protective wall 16 which is formed by folding inwardly the end of the other side plate 15 standing upright at another side edge of the rear plate portion 11 substantially at right angles to the side plate 15. Further, a projecting piece 13B formed at the end of the wall portion 13 is arranged to be engaged with an engaging hole 17 formed in the boundary portion between the side plate 15 and the protective wall 16.

Figure 4:
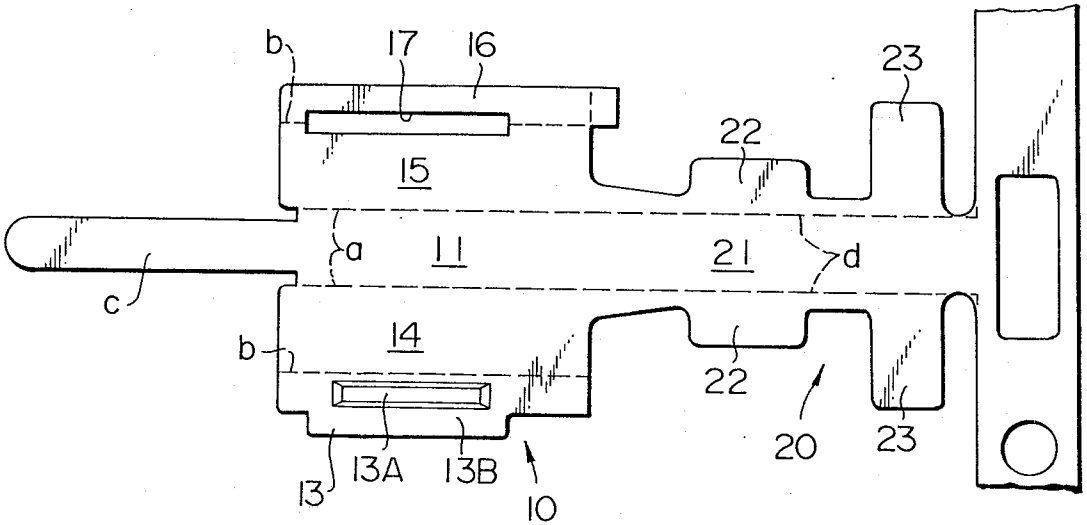
FIG. 4 is a developed view of the electrical connector of the present invention.

FIG. 4 is a developed view of the above-mentioned electrical connector. The electrically contacting portion 10 has the side plates 14, 15 formed integrally on both sides of the rear plate portion 11 through folding lines "a", and the wall portion 13 and the protective wall 16 formed integrally with the side plates 14 and 15, respectively, through folding lines "b". Further, the electrically contacting portion 10 has a web "c" formed integrally with one longitudinal end of the rear plate portion 11 and which is adapted to form the resilient contact piece 12. Further, the electric wire connecting portion 20 has a bottom plate portion 21 formed continuously with the rear plate portion 11, and side plates 22, 22 adapted to clamp the core of an electric wire, and side plates 23, 23 adapted to clamp the electric wire, both of the sides plates 22, 23 being formed integrally on both sides of the rear plate portion 21 through folding lines "d". The electrical connector shown in FIG. 1 is configured by folding back the web "e" towards the rear plate portion 11 and bending it in a circular-arc shape, and bending in turn the side plates 14, 15, the wall portion 13, the protective wall 16, and the side plates 22, 22, 23, 23 for clamping an electric wire through folding lines "a", "b" and "d", respectively.

When the outer surface of the wall portion 13 is covered with the protective wall 16, and also the projecting piece 13B formed at the end of the wall portion 13 is engaged in the engaging hole 17 formed in the boundary portion between the side plate 15 and the protective wall 16, a space 18 can be secured between the protective wall 16 and the projection 13A, and also the end of the wall portion 13 can be supported by the side plate 15.

Accordingly, even when an external force is exerted on the electrically contacting portion 10, the force is not exerted directly on the wall portion 13, but is exerted through the protective wall 16; that is, after it is relaxed by the protective wall 16, onto the wall portion 13. Further, even when an external force is exerted through the protective wall 16 onto the wall portion 13, it is not exerted on the projection 13A, because the space 18 is provided between the protective wall 16 and the projection 13A. Further, the external force exerted through the protective wall 16 is carried by the side plate 15.

Consequently, there is no possibility of the wall portion 13 and the projection 13A deforming towards the resilient contact piece 12 thereby narrowing excessively the spacing H between the projection 13A and the resilient contact piece 12, and so a proper contact pressure and male terminal inserting force can be established and a situation leading to a poor contact can be prevented without fail.

As mentioned hereinabove, according to the present invention, since the electrically contacting portion comprises the protective wall adapted to cover the outer surface of the wall portion and prevent possible deformation of the projection towards the resilient contact piece, there is no fear of the occurrence of a poor contact due to the deformation of the electrically contacting portion.

Figure 5:
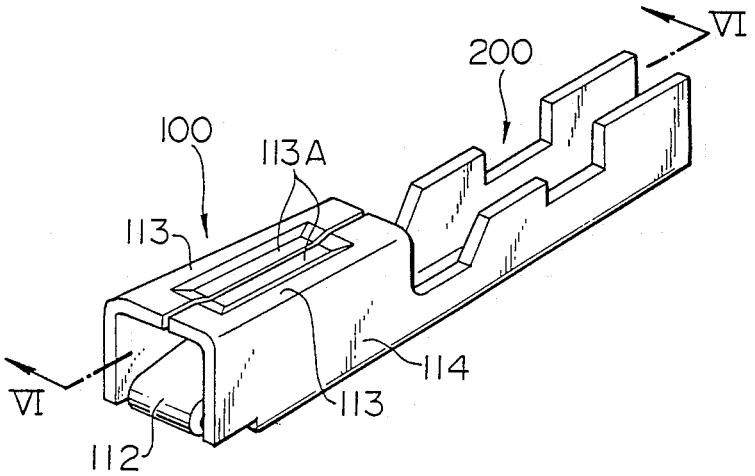
FIG. 5 PRIOR ART
FIG. 5 is a perspective view of a prior art electrical connector.
Figure 6:
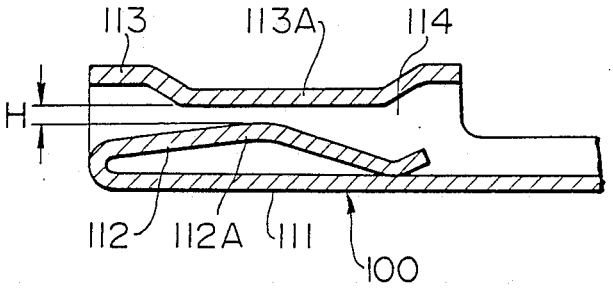
FIG. 6 PRIOR ART
FIG. 6 is a sectional view of the same taken along line VI—VI in FIG. 5.

A prior art female electrical connector shown in FIGS. 5 and 6 is comprised of a rectangular sleeve-shaped electrically contacting portion 100, and an electric wire connecting portion 200 of a substantially U-shape in section.

Disposed in the above-mentioned electrically contacting portion 100 is a resilient contact piece 112 formed by folding back a strip defined by extending one end of its rear plate portion 111 and bending the web in a circular-arc shape so as to give it a resiliency. Further, the electrically contacting portion 100 has a projection 113A formed on its wall 113 opposite to the resilient contact piece 112; that is, the rear plate portion 111 and which projects towards the resilient contact piece 112. The arrangement is made such that a male terminal can be gripped between the resilient contact piece 112 and the projection 113A to make electrical connection with the male terminal. The contact pressure in the electrically contacting portion, and hence, the force required to insert the main terminal is determined by the spacing H between the resilient contact piece 112 and the projection 113A. Further, the arrangement is made such that an electric wire, the core of which is exposed by peeling off the insulating coating at its portion to be electrically connected, is fixedly secured to the above-mentioned electric wire connecting portion 200 by a suitable means such as clamping or the like. In the drawing, reference numeral 114 denotes side plates formed integrally with the rear plate portion 111 on both sides thereof.

In the above-mentioned prior art electrical connector, when external forces are exerted on the wall portions 113, 113 to cause deformation of the projections 113A, 113A towards the resilient contact piece 112, the spacing H is narrowed thus requiring application of increased contact pressure in the electrically contacting portion 100, and hence, increased male terminal inserting force, and if the insertion of the male terminal is made repeatedly in this condition, then the curved portion 112A of the resilient contact piece 112 is deformed generally in a flat shape; in other words, the resilient contact piece 112 is worn down and loses its resiliency finally so that the contact pressure in the electrically contacting portion 100 is reduced, thus causing a poor electrical contact.

It is to be understood that the foregoing description is merely illustrative of a preferred embodiment of the present invention, and that the scope of the invention is not to be limited thereto, but is to be determined by the scope of the appended claim.

What is claimed is:

1. An electrical connector comprising: a substantially rectangular, sleeve-shaped electrically contacting portion in which a male terminal is to be inserted; and an electric wire connecting portion of a substantially U-shape in section which is formed integrally with the electrically contacting portion for fixedly securing an electric wire thereto, the arrangement being made such that a resilient contact piece formed by extending one wall of said electrically contacting portion is located in the electrically contacting portion, and a projection is formed by projecting part of the other wall of said electrically contacting portion opposite to the resilient contact piece towards the latter to thereby enable a male terminal to be gripped resiliently and held between the projection and said resilient contact piece, wherein a protective wall is formed by extending a side wall of said electrically contacting portion so that it may contact with and cover the outer surface of said other wall of said electrically contacting portion thereby preventing said projection from bulging towards said resilient contact piece.

* * * * *